US009212491B1

(12) United States Patent
Santini

(10) Patent No.: US 9,212,491 B1
(45) Date of Patent: Dec. 15, 2015

(54) MODULAR STAIRWAY

(71) Applicant: Patrick J. Santini, West Bend, WI (US)

(72) Inventor: Patrick J. Santini, West Bend, WI (US)

( * ) Notice: Subject to any disclaimer, the term of this patent is extended or adjusted under 35 U.S.C. 154(b) by 0 days.

(21) Appl. No.: 14/720,232

(22) Filed: May 22, 2015

(51) Int. Cl.

| | |
|---|---|
| ***E04F 11/00*** | (2006.01) |
| ***E04F 11/035*** | (2006.01) |
| ***E04F 11/02*** | (2006.01) |
| ***E04F 11/025*** | (2006.01) |
| ***E04F 11/028*** | (2006.01) |

(52) U.S. Cl.
CPC ..... *E04F 11/035* (2013.01); *E04F 11/02* (2013.01); *E04F 11/025* (2013.01); *E04F 11/028* (2013.01)

(58) Field of Classification Search
USPC ..... 52/182, 183, 188, 191, 646, 655.1, 839
See application file for complete search history.

(56) References Cited

U.S. PATENT DOCUMENTS

| | | | | | |
|---|---|---|---|---|---|
| 1,075,156 | A * | 10/1913 | Nesdall | E04F 11/025 | 52/191 |
| 3,196,997 | A * | 7/1965 | Hager | E04F 11/035 | 52/182 |
| 4,875,315 | A * | 10/1989 | Champagne | E04F 11/025 | 52/189 |
| 4,951,434 | A * | 8/1990 | Schmidt | E04F 11/025 | 52/185 |
| 5,778,610 | A * | 7/1998 | Berg | E04F 11/1041 | 52/105 |
| 6,029,408 | A * | 2/2000 | Cavaness | E04F 11/025 | 52/182 |
| 7,617,652 | B1 * | 11/2009 | Flatmoe | E04F 11/025 | 52/191 |
| 8,418,425 | B1 | 4/2013 | Santini | | |
| 2003/0093959 | A1 | 5/2003 | Couture | | |
| 2010/0132277 | A1 | 6/2010 | Bush | | |
| 2012/0167521 | A1 * | 7/2012 | Cretti | E04F 11/022 | 52/741.2 |
| 2012/0266551 | A1 * | 10/2012 | Greaves | E04D 13/12 | 52/188 |
| 2013/0000231 | A1 * | 1/2013 | Greaves | E04D 13/12 | 52/183 |
| 2014/0326359 | A1 * | 11/2014 | Bennett | B29C 41/04 | 141/1 |

* cited by examiner

*Primary Examiner* — Charles A Fox
*Assistant Examiner* — James Buckle, Jr.
(74) *Attorney, Agent, or Firm* — Donald J. Ersler

(57) ABSTRACT

A modular stairway preferably includes a tubular beam, a plurality of stringers and a plurality of stair treads. A short modular stairway includes at least two stringers and a plurality of stair treads. The tubular beam includes a rectangular tube, a first end plate and a second end plate. A plurality of redundant tube access openings are formed through a length of each side of the rectangular tube. A fastener hole pattern is formed concentric with each tube access opening. Each stringer includes an elongated section and an end plate. A plurality of redundant stringer access openings are formed through a length of the elongated section. A fastener hole pattern is formed concentric with each stringer access opening. The stair tread is preferably fabricated from a single piece of material. The stair tread includes a step section, a first attachment flange, a support section and a second attachment flange.

17 Claims, 18 Drawing Sheets

MODULAR STAIRWAY

BACKGROUND OF THE INVENTION

1. Field of the Invention

The present invention relates generally to buildings and more specifically to a modular stairway, which allows a staircase to be temporarily or permanently constructed.

2. Discussion of the Prior Art

Patent publication no. 2003/0093959 to Couture discloses components for modular stairway system. Patent publication no. 2010/0132277 to Bush discloses a modular staircase system. U.S. Pat. No. 8,418,425 to Santini discloses a tubular beam for the construction of temporary structures.

Accordingly, there is a clearly felt need in the art for a modular stairway, which allows a staircase to be temporarily or permanently assembled from two or three different elements.

SUMMARY OF THE INVENTION

The present invention provides a modular stairway, which allows a staircase to be temporarily constructed. The modular stairway preferably includes a tubular beam, a plurality of stringers and a plurality of stair treads. A short modular stairway includes at least two stringers and a plurality of stair treads. The tubular beam is described in patent application Ser. No. 14/661,025 filed on Mar. 18, 2015, this patent application is hereby incorporated by reference in its entirety. The tubular beam includes a rectangular tube, a first end plate and a second end plate. A plurality of redundant tube access openings are preferably formed through a length of each side of the rectangular tube. A fastener hole pattern is preferably formed concentric with each tube access opening. The first end plate is welded to a first end of the rectangular tube and the second end plate is welded to a second end of the rectangular tube. A plate access opening is formed through the first and second end plates. The fastener hole pattern is preferably formed concentric with the plate access opening. The fastener hole pattern preferably includes four inner perimeter fastener holes preferably arraigned in a rectangular pattern and ten outer perimeter fastener holes preferably arraigned in a rectangular pattern.

Each stringer preferably includes an elongated section and an end plate. The elongated section includes a U-shaped cross section, which is preferably formed from a single sheet of material. The U-shaped cross section includes a base section, a first side section and a second side section. The first side section extends downward from a first side of the base section and the second side section extends downward from a second side of the base section. A plurality of redundant tube access openings are preferably formed through a length of the base section. A fastener hole pattern is preferably formed concentric with each tube access opening. The fastener hole pattern preferably includes four perimeter fastener holes preferably arraigned in a rectangular pattern. A plurality of fastener holes are formed through a length of the first and second side sections. A first end of the first and second side sections are preferably chamfered to lay flat on a horizontal surface. A second end of the first and second side sections are flared outward to provide additional support for the end plate. The end plate is preferably welded to the second end of the base, first side and second side sections. A plurality of fastener holes are formed through the end plate for attachment to a side of a floor.

The stair tread is preferably fabricated from a single piece of material. The stair tread includes a step section, a first attachment flange, a support section and a second attachment flange. The step section is the horizontal portion of the stair tread. The first attachment flange extends inward from one side of the step section. The support section extends inward from an opposing side of the step section. The second attachment flange extends inward from a distal end of the support section. The first and second attachment flanges are secured to the support beam or stringers with a plurality of fasteners.

In a first modular stairway embodiment, two first stringers are attached to opposing sides of a first end of the tubular beam and two second stringers are attached to opposing sides of a second end of the tubular beam to form a stair support structure. A plurality of stair treads are attached to the four stringers and the tubular beam. A second modular stairway embodiment includes three stair support structures, a first plurality of stair treads and a second plurality of stair treads. The first plurality of stair treads are attached to a first stair support structure and a first half of a second stair support structure. The second plurality of stair treads are attached to a second half of the second stair support and to a third stair support structure.

In a first short modular stairway embodiment, each end of a stair tread is attached to a single stringer. In a second short modular stairway embodiment, sides of two stringers are bolted to each other and a middle of each stair tread is attached to the two stringers. In a third short modular stairway embodiment, a first stringer is attached to one end of a plurality of first stair treads. A second stringer is attached to an opposing end of the plurality of first stair treads and one end of a plurality of second stair treads. A third stringer is attached to an opposing end of the plurality of second stair treads.

A fourth short modular stairway embodiment includes the plurality of stair treads and four stringers. Sides of first and second stringers are attached to each other. One end of a third stringer is attached to an opposing side and distal end of the first stringer. One end of a fourth stringer is attached to an opposing side and distal end of the second stringer. The plurality of stair treads are attached to the first and second stringers; or the third and fourth stringers. A fifth short modular stairway embodiment includes the second short modular stairway embodiment and two additional stringers. The two additional stringers are attached to outside surfaces of the two stringers of the second embodiment. The plurality of stair treads are attached to the four stringers.

Accordingly, it is an object of the present invention to provide a modular stairway, which allows a staircase to be temporarily or permanently assembled from three different elements.

Finally, it is an object of the present invention to provide a modular stairway, which allows a short staircase to be temporarily or permanently assembled from two different elements.

These and additional objects, advantages, features and benefits of the present invention will become apparent from the following specification.

DETAILED DESCRIPTION OF THE PREFERRED EMBODIMENTS

Figure 1:
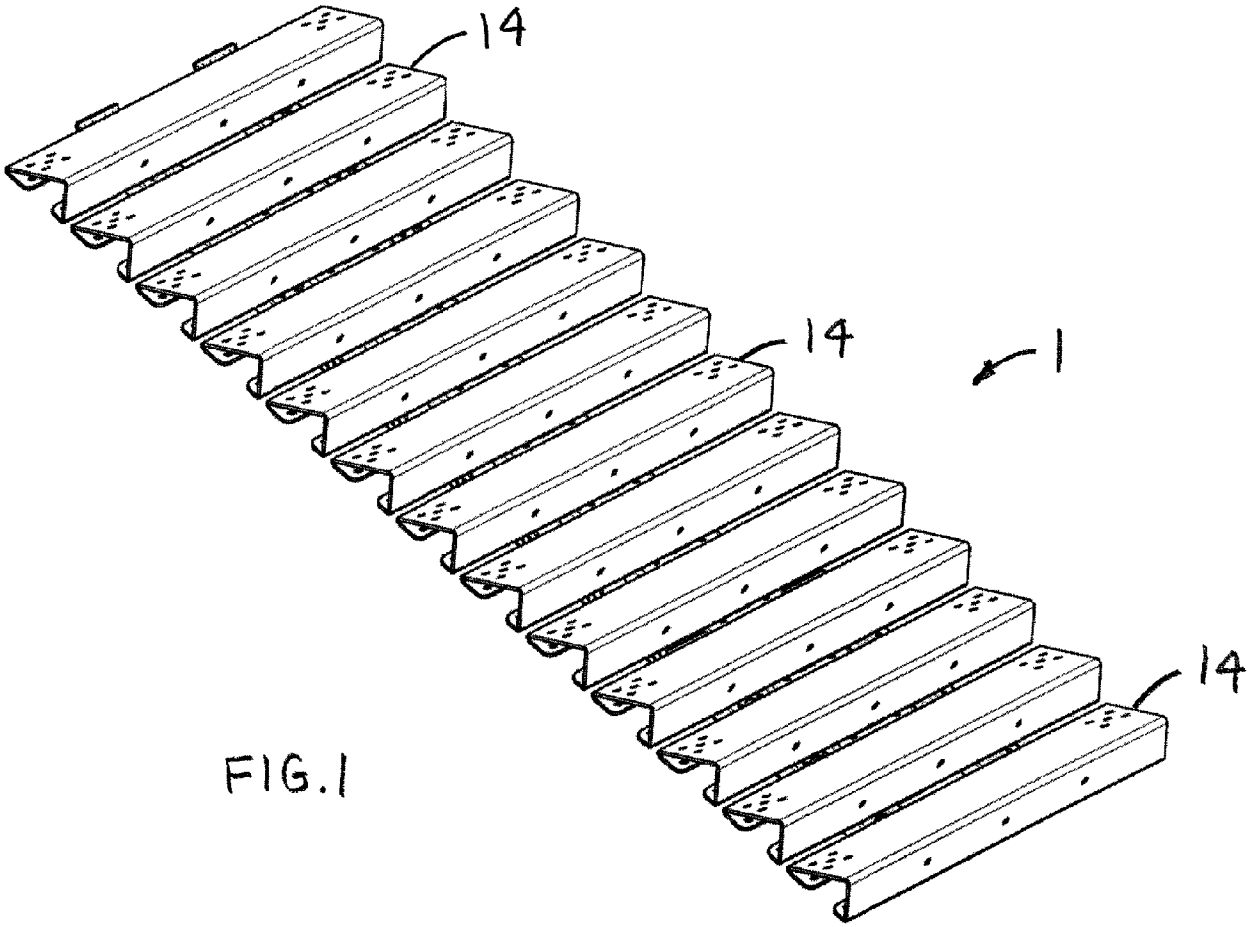
FIG. 1 is a top perspective view of a modular stairway in accordance with the present invention.
Figure 2:
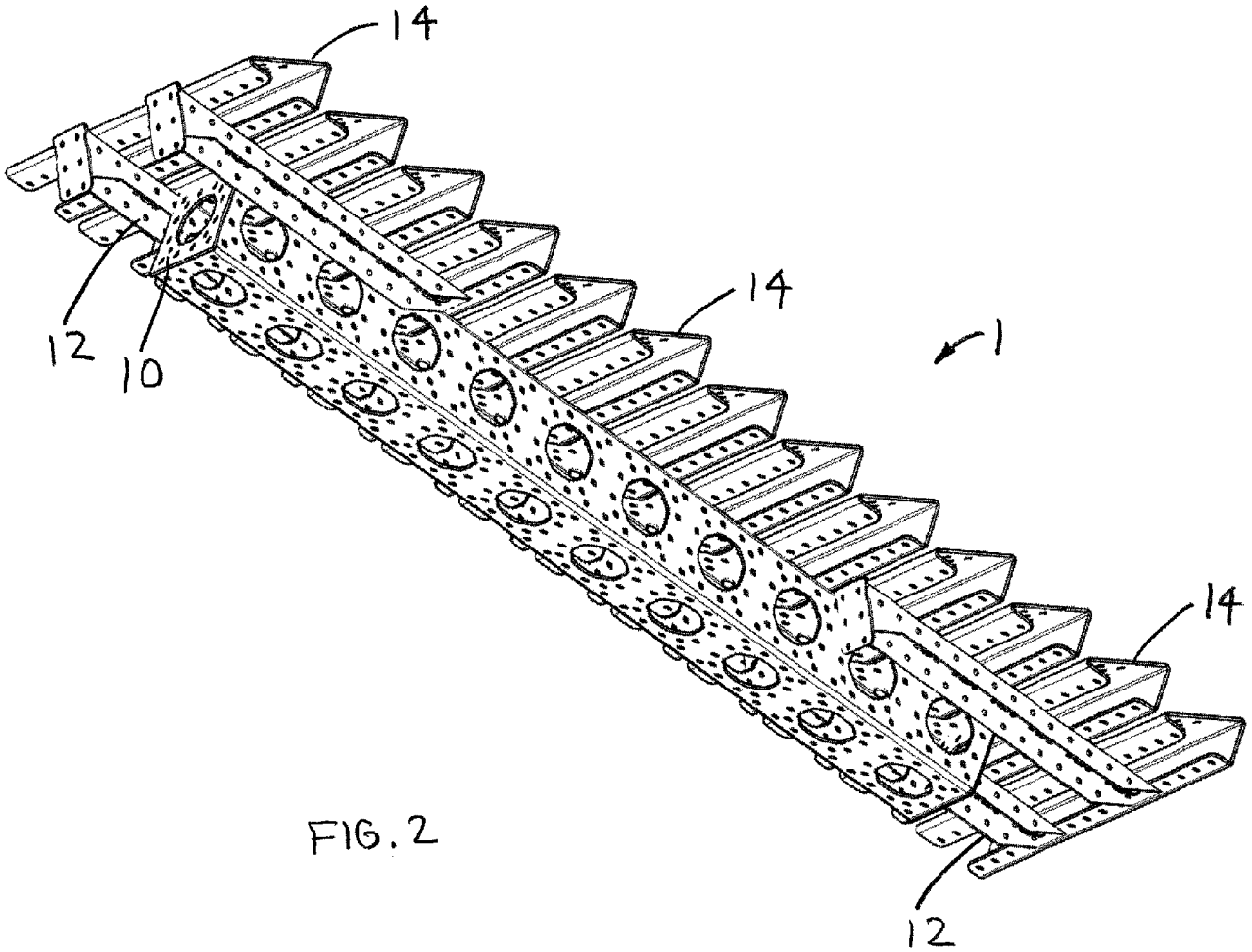
FIG. 2 is a bottom perspective view of a modular stairway in accordance with the present invention.
Figure 3:
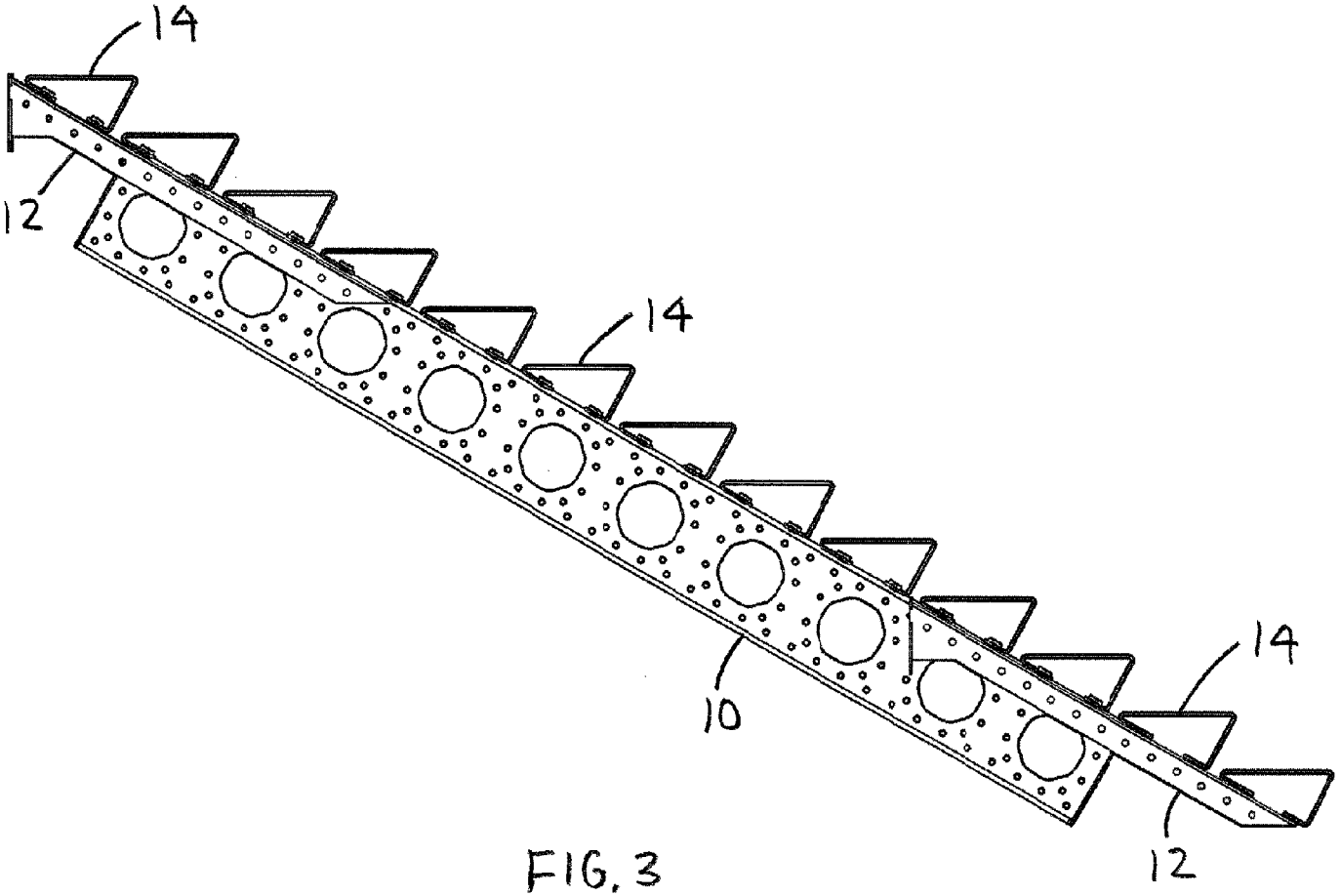
FIG. 3 is a side view of a modular stairway in accordance with the present invention.
Figure 5:
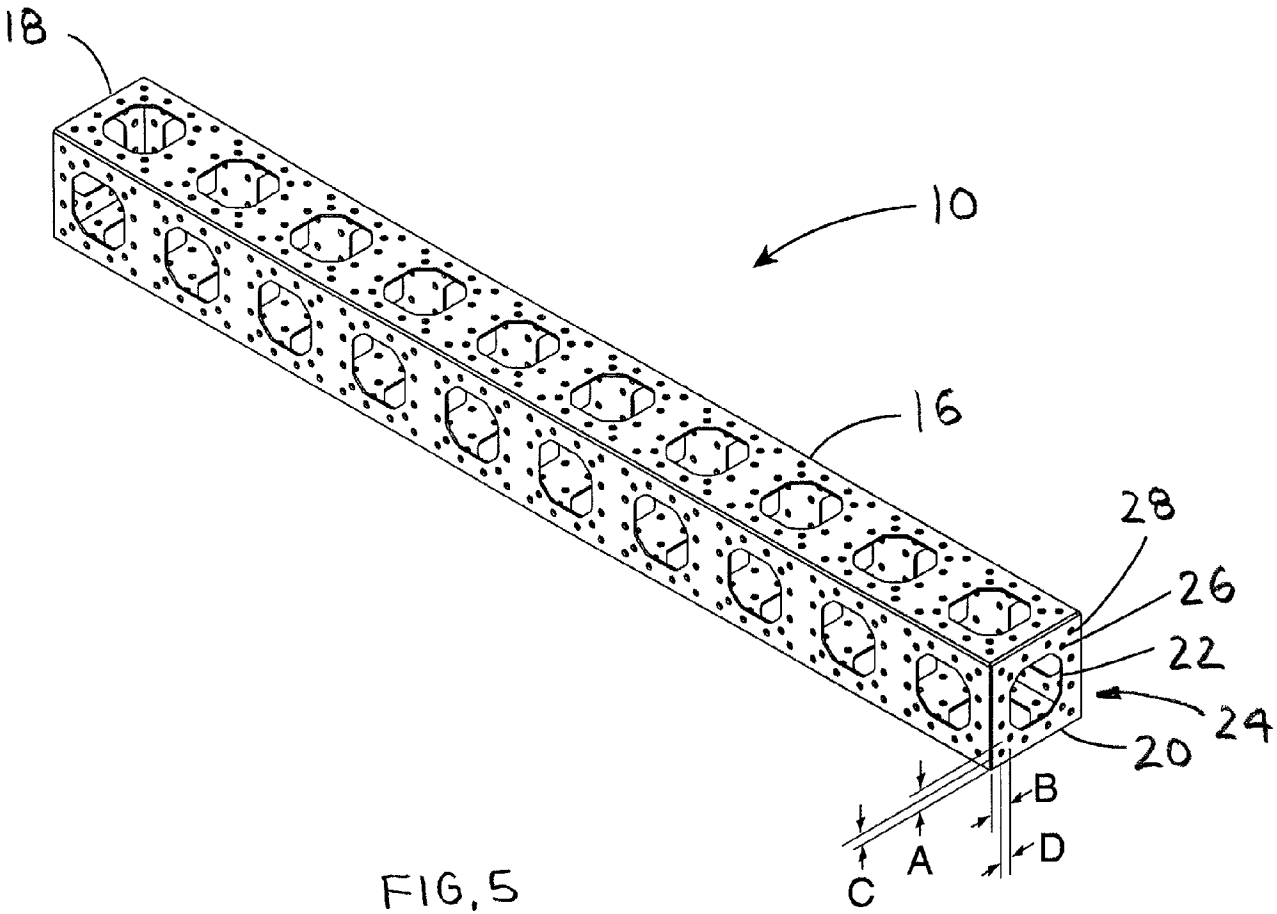
FIG. 5 is a perspective view of a tubular beam of a modular stairway in accordance with the present invention.
Figure 6:
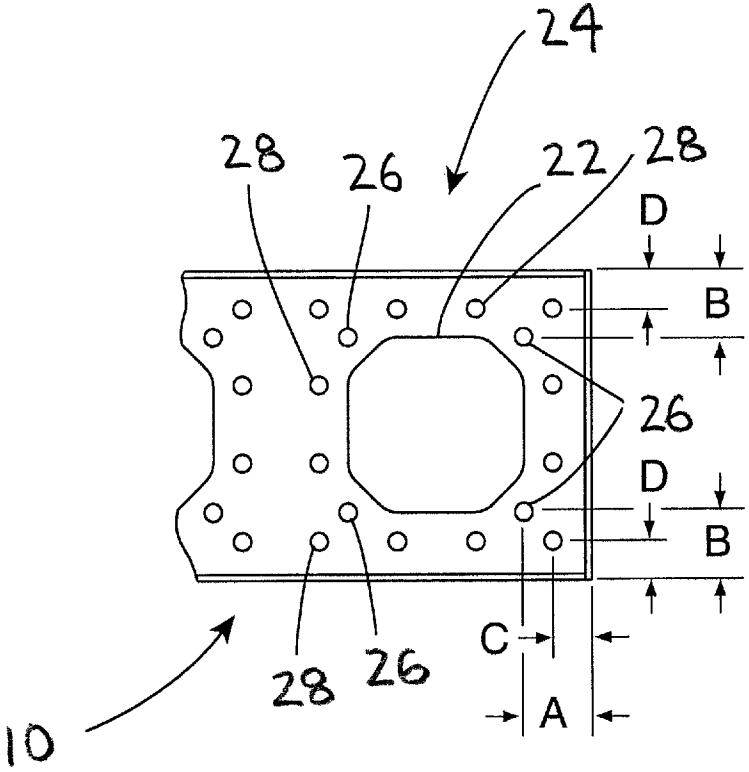
FIG. 6 is a partial enlarged top view of a tubular beam of a modular stairway illustrating an access opening and hole pattern in accordance with the present invention.

With reference now to the drawings, and particularly to FIG. 1, there is shown a top perspective view of a modular stairway 1. With reference to FIGS. 2-3, the modular stairway 1 preferably includes a tubular beam 10, a plurality of stringers 12 and a plurality of stair treads 14. A short modular stairway 2 includes at least two stringers 12 and a plurality of stair treads 14. With reference to FIGS. 5-6, the tubular beam 10 includes a rectangular tube 16, a first end plate 18 and a second end plate 20. A plurality of redundant tube access openings 22 are preferably formed through a length of each side of the rectangular tube. A fastener hole pattern 24 is preferably formed concentric with each tube access opening 22. The first end plate 18 is welded to a first end of the rectangular tube 16 and the second end plate 20 is welded to a second end of the rectangular tube 16. The tube access opening 22 is formed through the first and second end plates 18, 20. The fastener hole pattern 24 is preferably formed concentric with the tube access opening 22. The fastener hole pattern 24 preferably includes four inner perimeter fastener holes 26 preferably arraigned in a rectangular pattern and ten outer perimeter fastener holes 28 preferably arraigned in a rectangular pattern.

The distance "A" between the two inner perimeter fastener holes 26 and each end of the tubular beam 10 is equal to the distance "B" between the two inner perimeter fastener holes 26 and each side of the tubular beam 10. The distance "C" between the four outer perimeter fastener holes 28 and each end of the tubular beam 10 is equal to the distance "D" between the four outer perimeter fastener holes 28 and each side of the tubular beam 10. The plurality of tube access openings 22 are preferably equidistant from each other. It is preferable that the distance between adjacent perimeter inner perimeter fastener holes 26 be 6¾ inches and the distance between adjacent outer perimeter fastener holes 28 be 3.0 inches, but other distances may also be used.

Figure 4A:
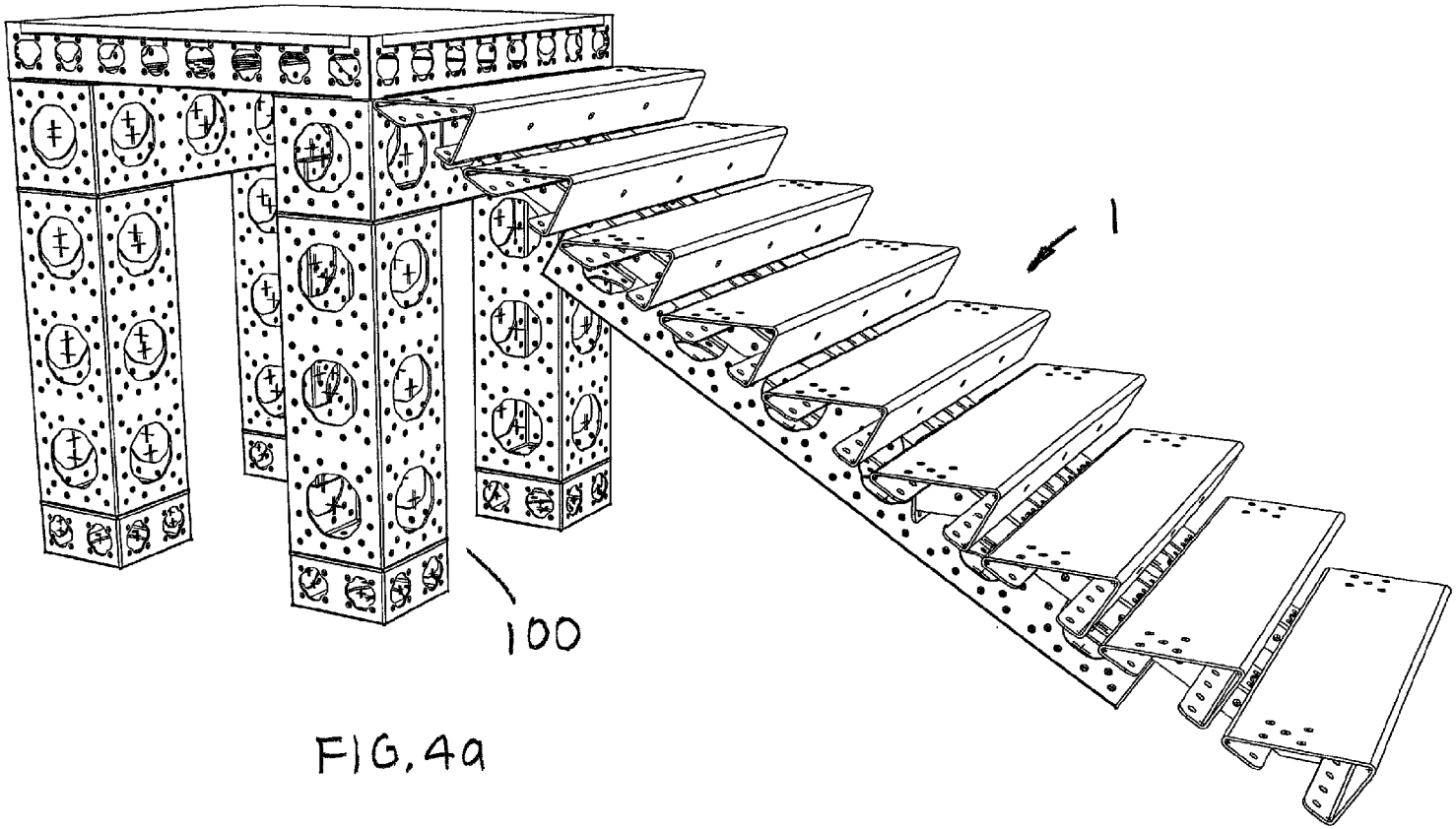
FIG. 4*a* is a perspective view of a modular stairway attached to a support structure in accordance with the present invention.
Figure 7:
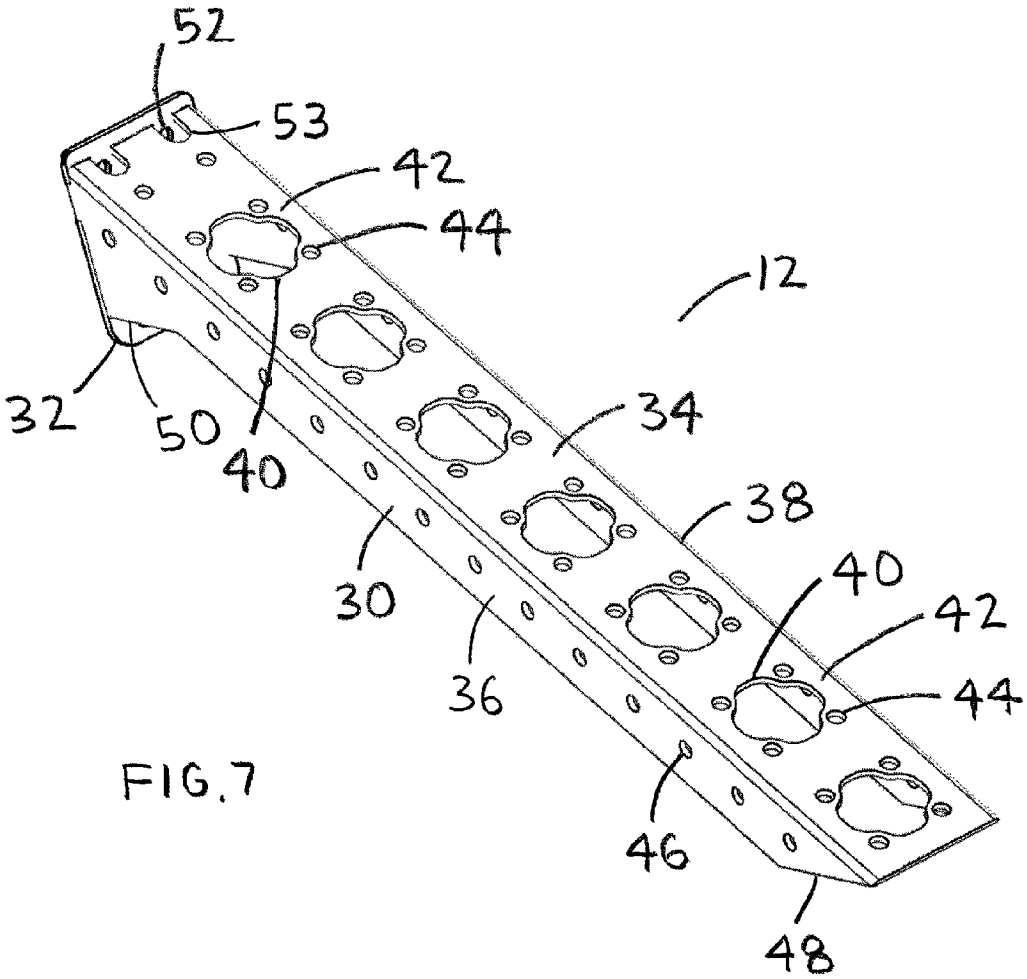
FIG. 7 is a top perspective view of a stringer of a modular stairway in accordance with the present invention.
Figure 8:
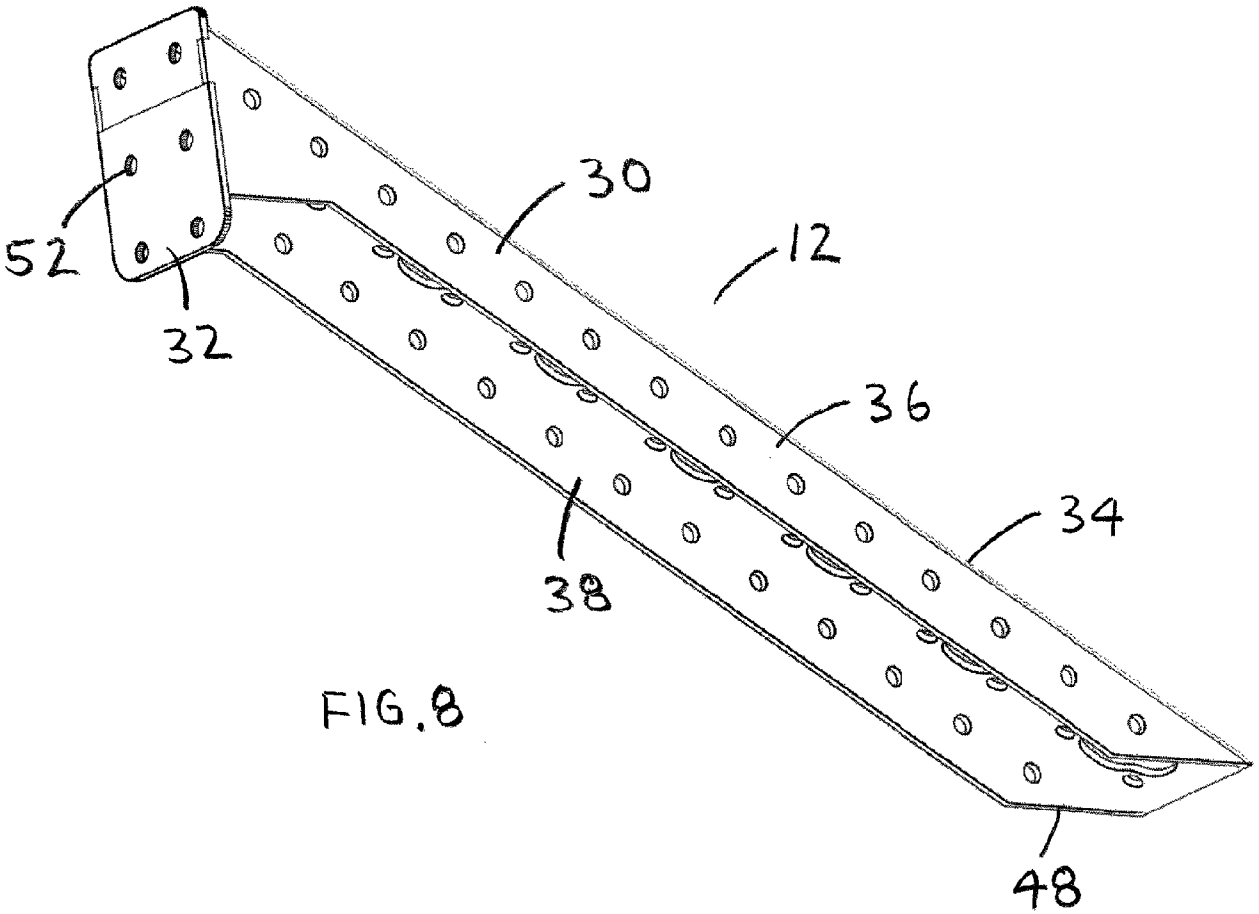
FIG. 8 is a bottom perspective view of a stringer of a modular stairway in accordance with the present invention.

With reference to FIGS. 7-8, each stringer 12 preferably includes an elongated section 30 and an end plate 32. The elongated section 30 includes a U-shaped cross section, which is preferably formed from a single sheet of material. The U-shaped cross section includes a base section 34, a first side section 36 and a second side section 38. The first side section 36 extends downward from a first side of the base section 34 and the second side section 38 extends downward from a second side of the base section 38. A plurality of redundant tube access openings 40 are preferably formed through a length of the base section 34. A fastener hole pattern 42 is preferably formed concentric with each tube access opening 40. The fastener hole pattern preferably includes four inner perimeter fastener holes 44 preferably arraigned in a rectangular pattern. A plurality of fastener holes 46 are formed through a length of the first and second side sections. A chamfer 48 is formed on a first end of the first and second side sections, such that the stringer 12 lays flat on a horizontal surface. A flared portion 50 extends outward from a second end of the first and second side sections to provide additional support for the end plate 32. The end plate 32 is preferably welded to the second end of the base 34, first side 36 and second side sections 38. With reference to FIG. 4*a*, a plurality of fastener holes 52 are formed through the end plate 32 for attachment to a support structure 100. A pair of fastener cutout openings 53 are formed in an end of the elongated section 30 to provide clearance for insertion of fasteners into the top two fastener holes 52 in the end plate 32.

Figure 9A:
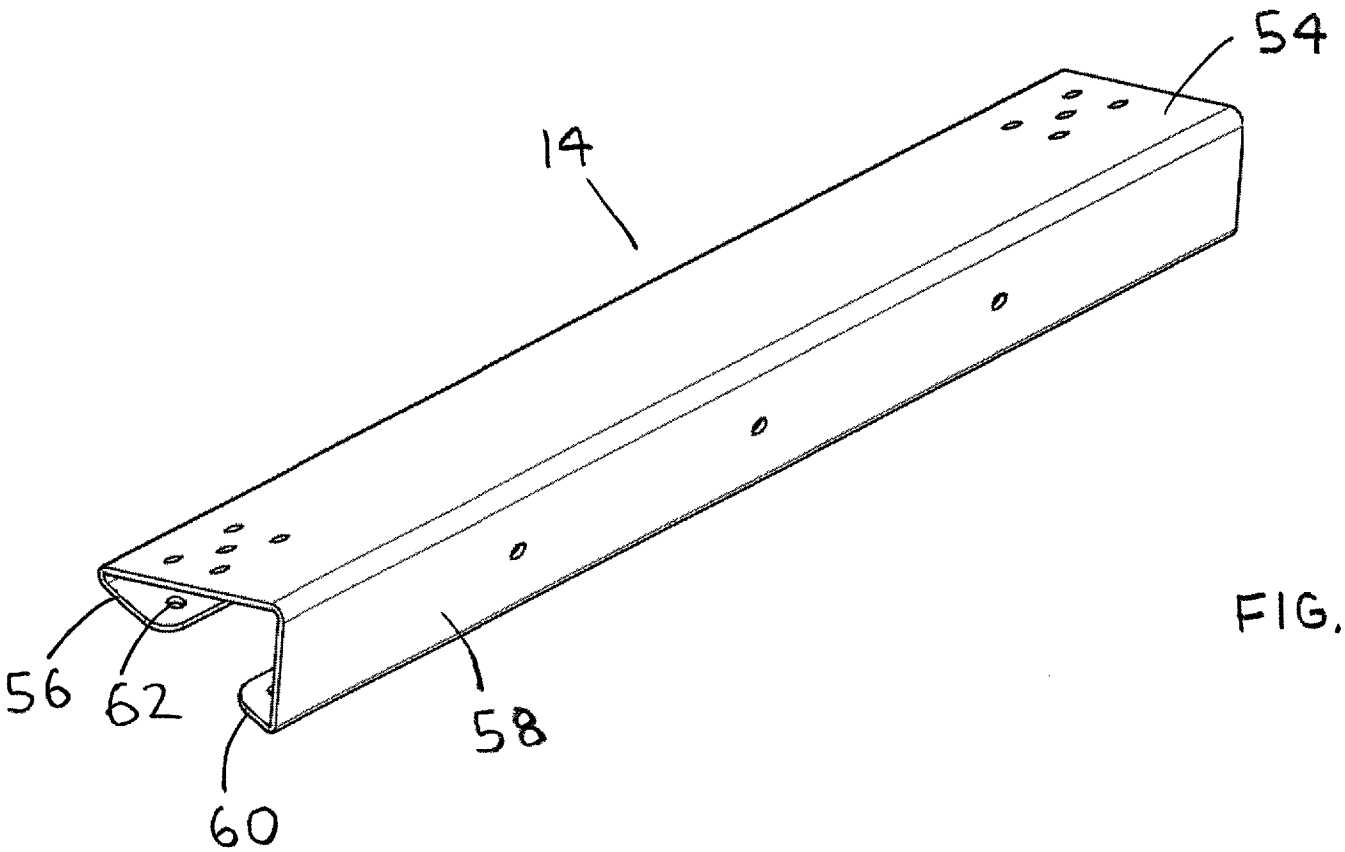
FIG. 9*a* is a top perspective view of a stair tread of a modular stairway in accordance with the present invention.
Figure 9B:
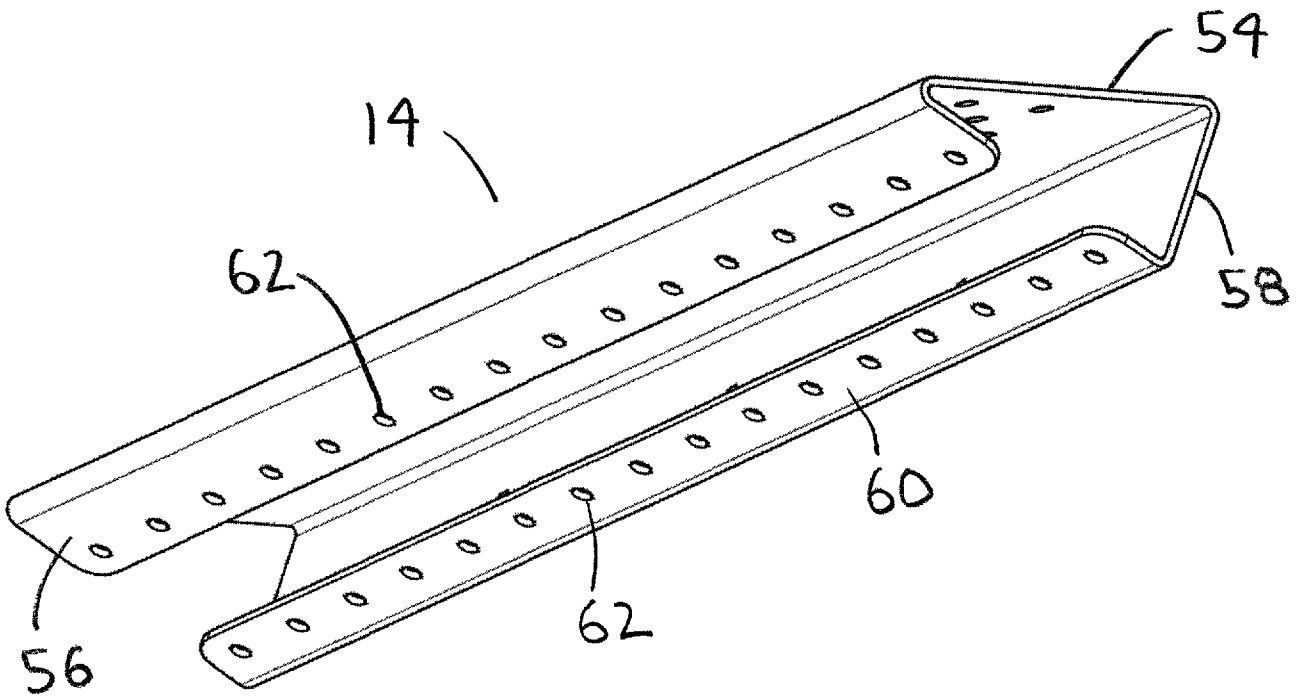
FIG. 9*b* is a bottom perspective view of a stair tread of a modular stairway in accordance with the present invention.

With reference to FIGS. 9*a*-9*b*, the stair tread 14 is preferably fabricated from a single piece of material. The stair tread 14 includes a step section 54, a first attachment flange 56, a support section 58 and a second attachment flange 60. The step section 54 is a horizontal portion of the stair tread 14. The first attachment flange 56 extends inward from one side of the step section 54. The support section 58 extends downward from an opposing side of the step section 54. The second attachment flange 60 extends inward from a distal end of the support section 58. A plurality of fastener holes 62 are formed through the first attachment flange 56 and the second attachment flange 60. The first and second attachment flanges 56, 60 are secured to the support beam with a plurality of fasteners.

Figure 10:
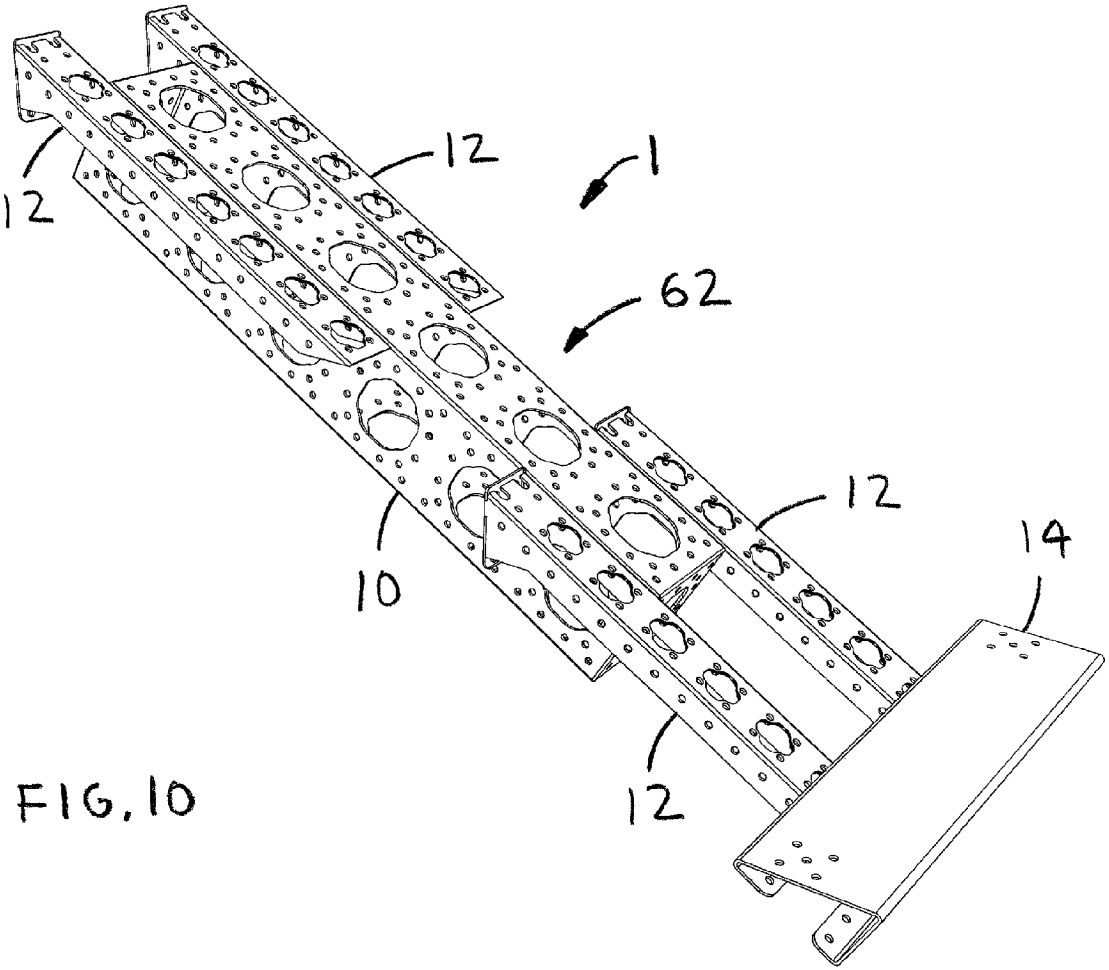
FIG. 10 is a perspective view of a modular stairway in accordance with the present invention.
Figure 11:
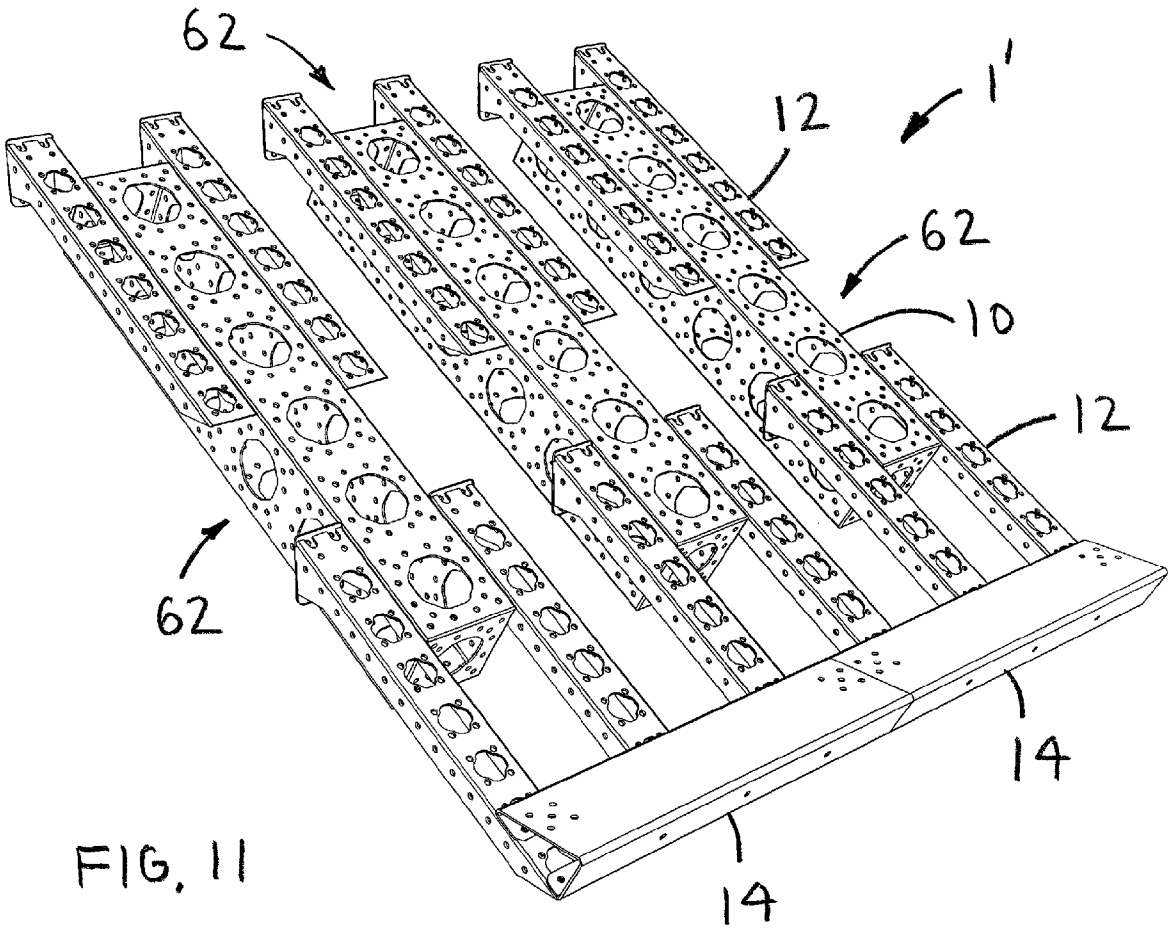
FIG. 11 is a perspective view of a second modular stairway with two columns of stair treads in accordance with the present invention.

With reference to FIG. 10, the first modular stairway embodiment 1 includes two first stringers 12 attached to opposing sides of a first end of the tubular beam 10 and two second stringers 12 attached to opposing sides of a second end of the tubular beam 10 to form a stair support structure 62. A plurality of stair treads 14 are attached to the tubular beam 10 and the four stringers 12. With reference to FIG. 11, a second modular stairway embodiment 1' includes three stair support structures 62, a first plurality of stair treads 14 and a second plurality of stair treads 14. The first plurality of stair treads 14 are attached to the first stair support structure 62 and a first half of the second stair support structure 62. The second plurality of stair treads 14 are attached to a second half of the second stair support 62 and to the third stair support structure 62.

Figure 4B:
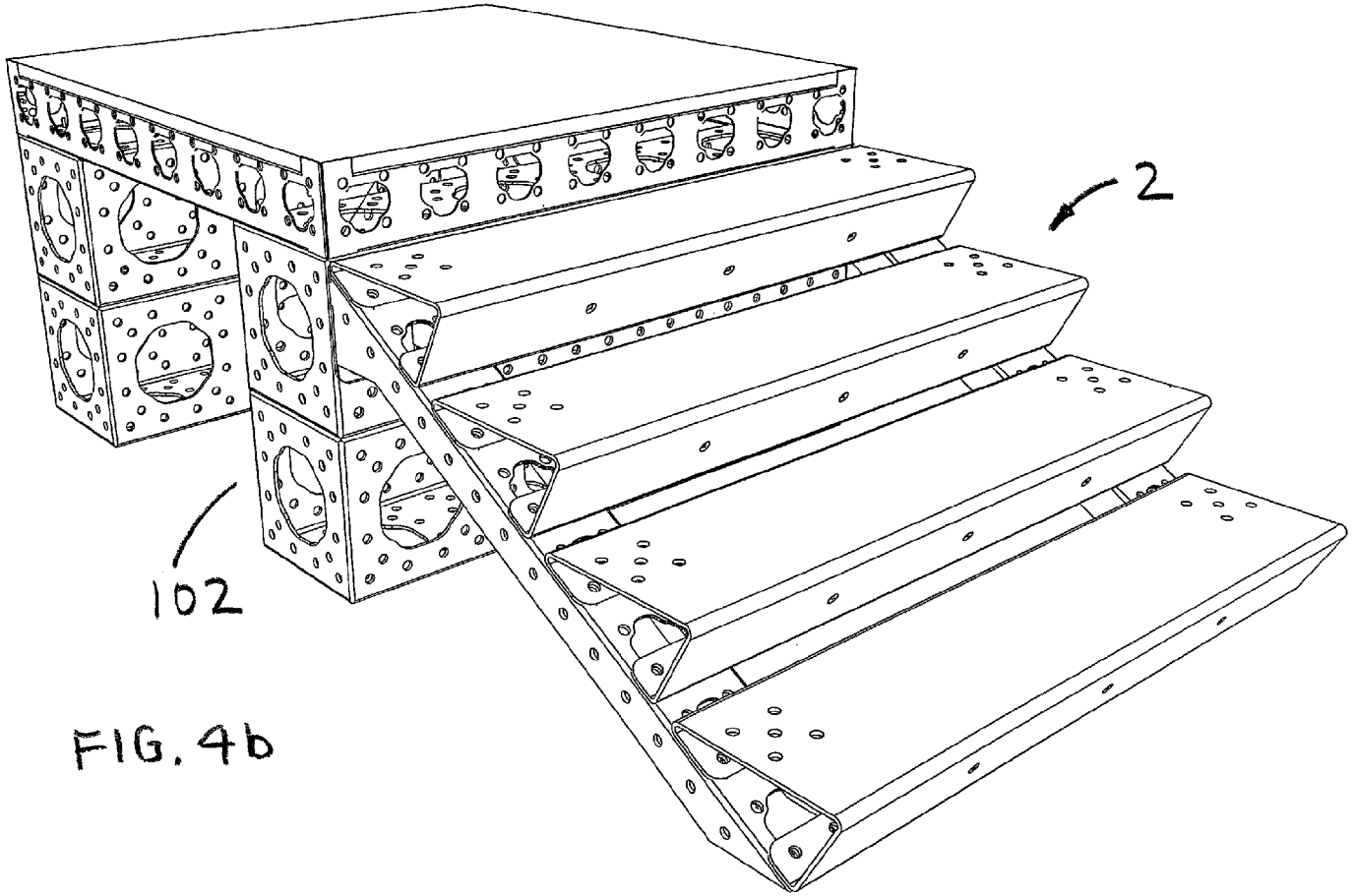
FIG. 4*b* is a perspective view of a short modular stairway attached to a support structure in accordance with the present invention.
Figure 12:
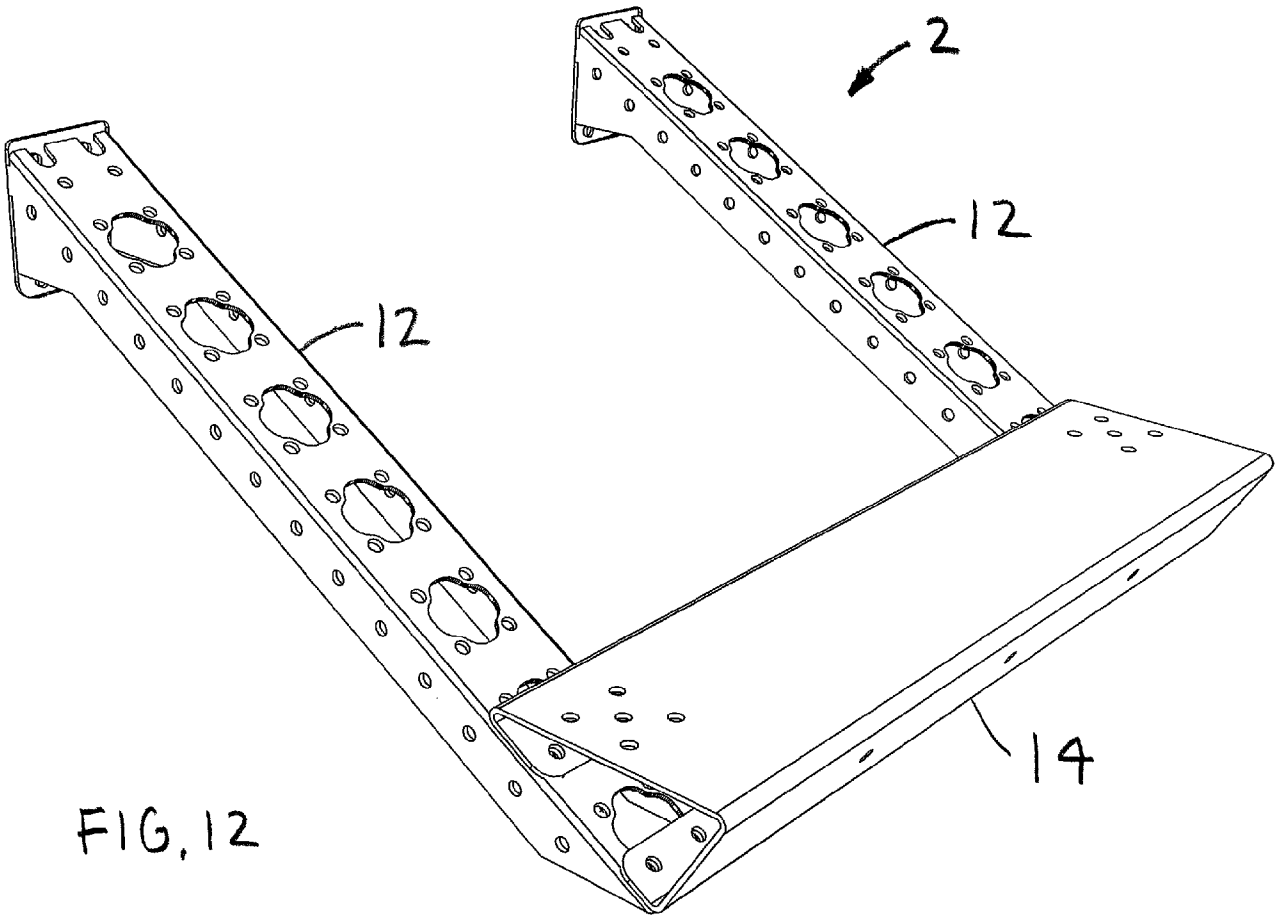
FIG. 12 is a perspective view of a short modular stairway in accordance with the present invention.
Figure 13:
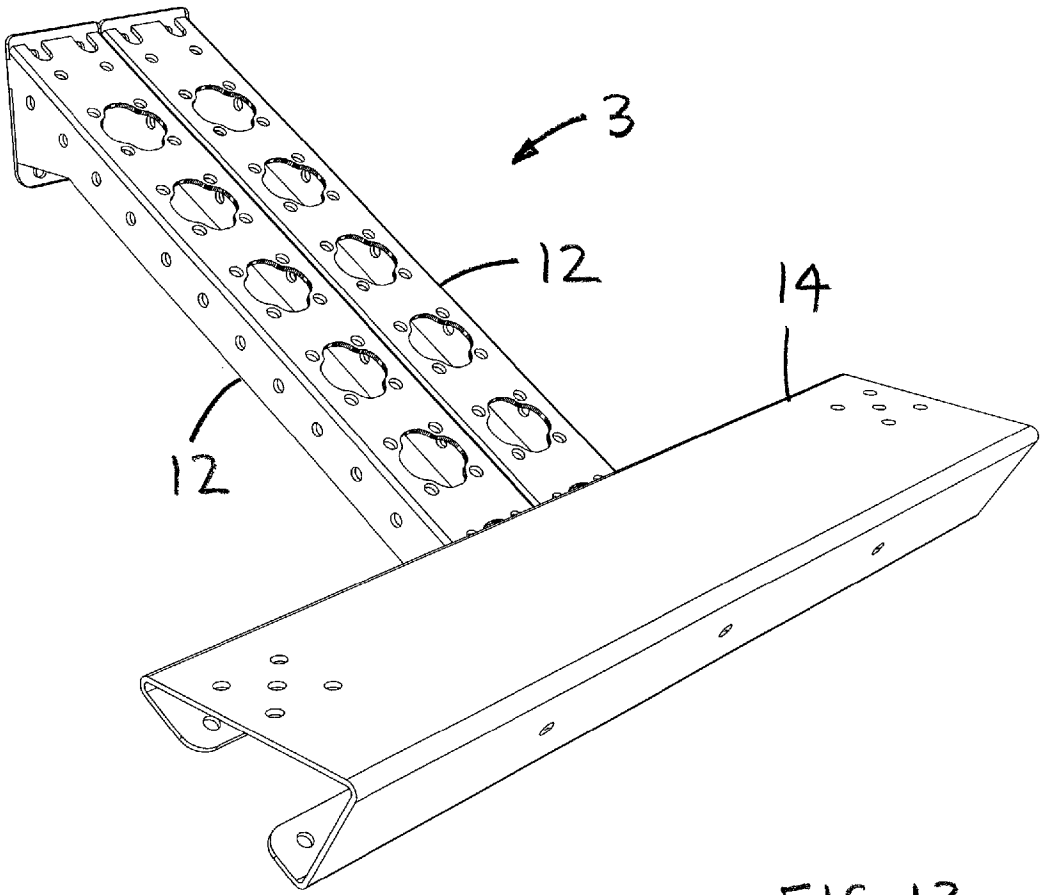
FIG. 13 is a perspective view of a second embodiment of a short modular stairway in accordance with the present invention.
Figure 14:
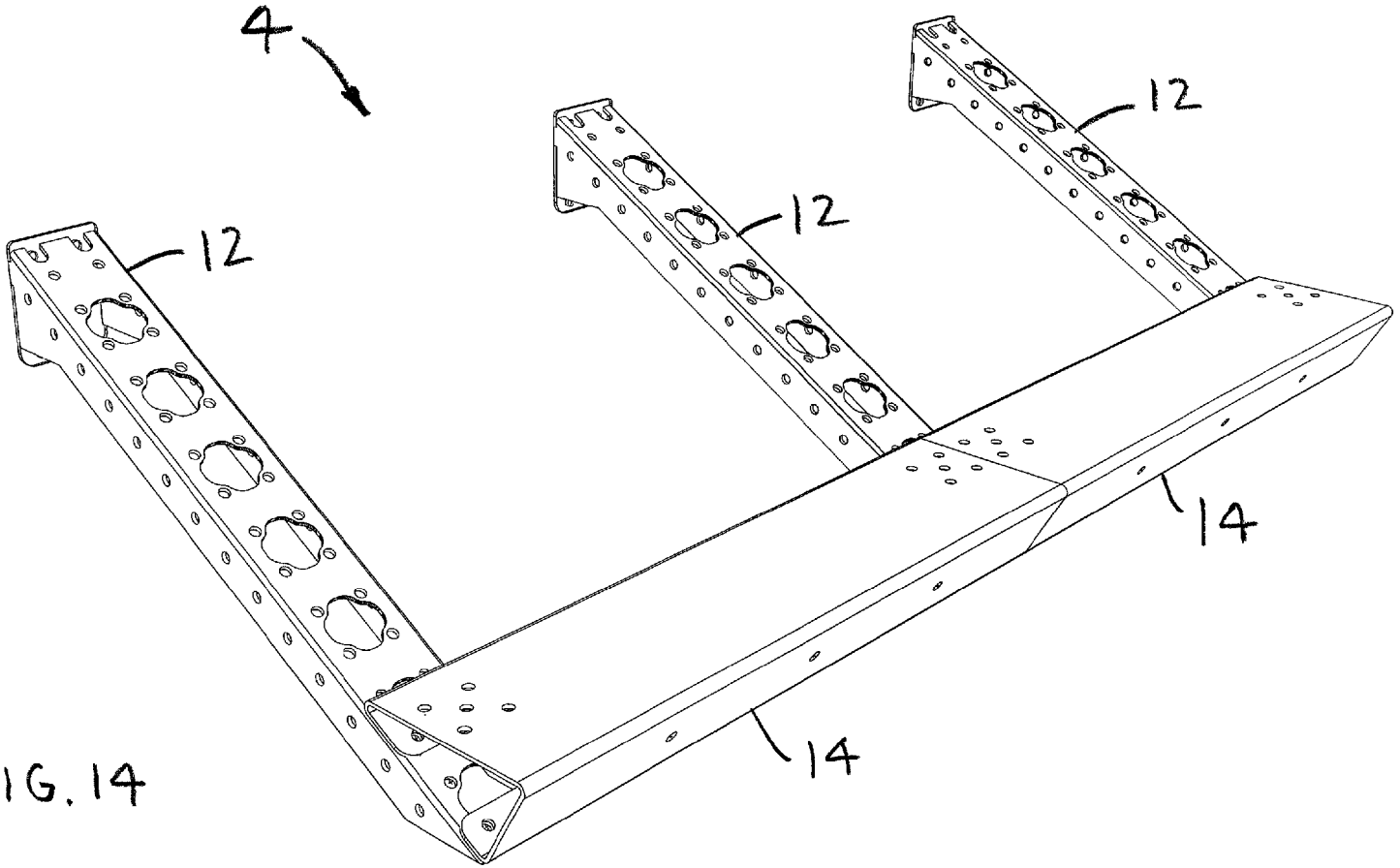
FIG. 14 is a perspective view of a third embodiment of a short modular stairway with two columns of stair treads in accordance with the present invention.

With reference to FIGS. 12-17, a short modular stairway 2-6 includes the at least two stringers 12 and the plurality of stair treads 14. With reference to FIG. 12, a first short modular stairway embodiment 2 includes each end of a plurality of stair treads 14 attached to a single stringer 12. With reference to FIG. 4*b*, the first short modular stairway embodiment 2 is attached to a support structure 102. With reference to FIG. 13, a second short modular stairway embodiment 3 includes sides of two stringers 12 bolted to each other and a middle of a plurality of stair treads 14 attached to the two stringers 12. With reference to FIG. 14, a third short modular stairway embodiment 4 includes a first stringer 12 attached to a first end of a plurality of first stair treads 14. A second stringer 14 is attached to an opposing end of the plurality of first stair treads 14 and one end of a plurality of second stair treads 14. A third stringer is attached to an opposing end of the plurality of second stair treads 14.

Figure 15:
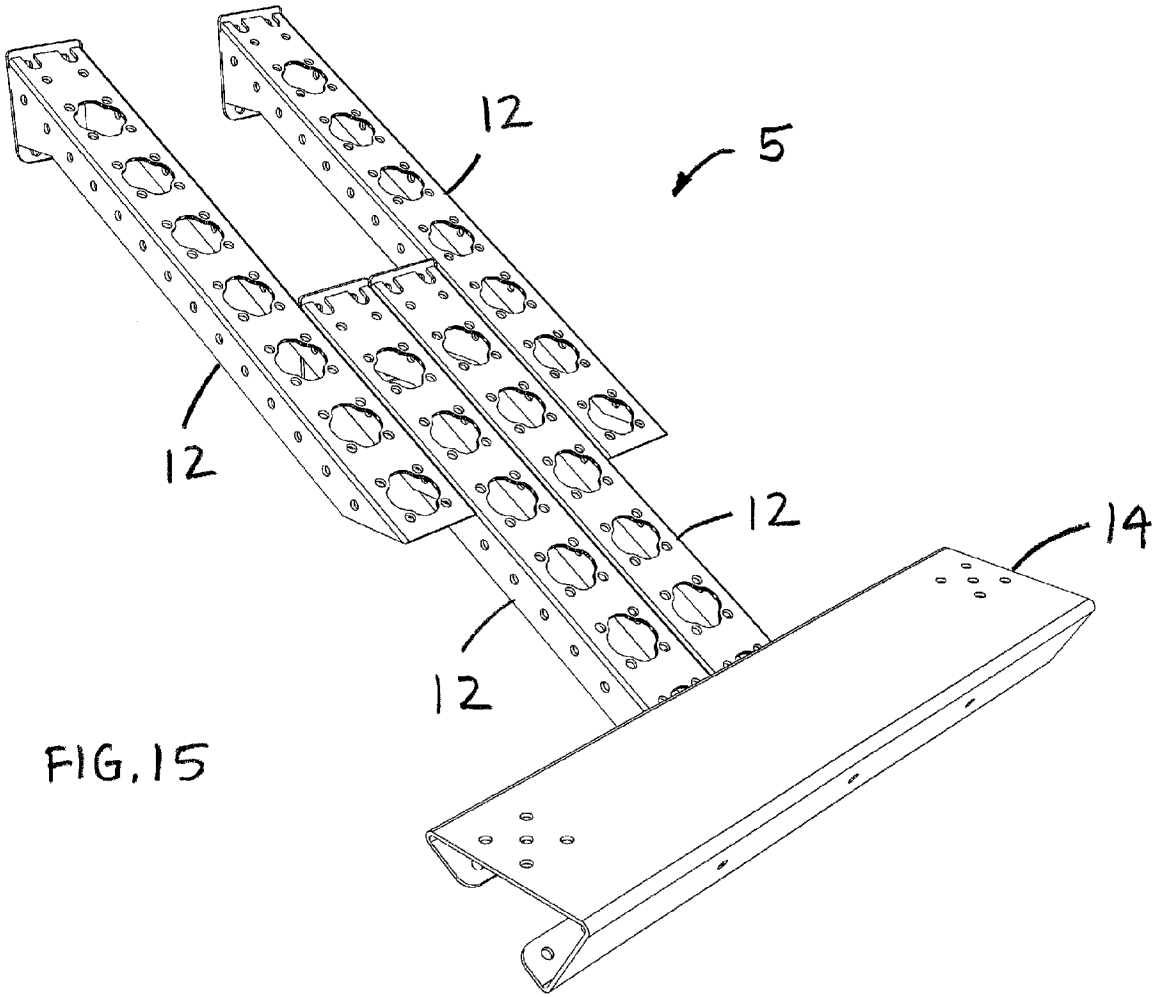
FIG. 15 is a perspective view of a fourth embodiment of a short modular stairway in accordance with the present invention.
Figure 16:
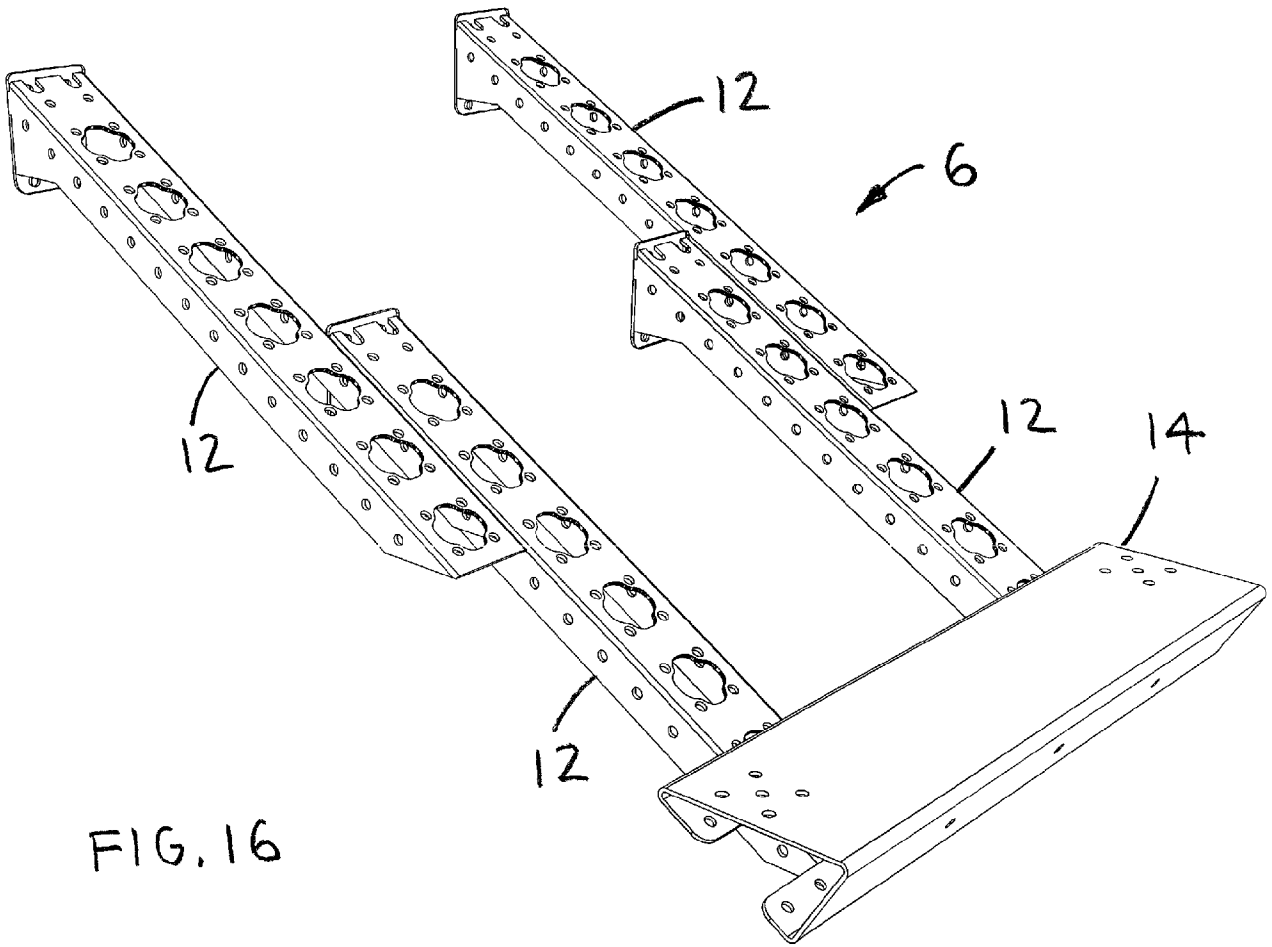
FIG. 16 is a perspective view of a fifth embodiment of a short modular stairway in accordance with the present invention.

With reference to FIG. 15, a fourth short modular stairway embodiment 5 includes the plurality of stair treads 14 and four stringers 12. Sides of first and second stringers 12 are attached to each other. One end of a third stringer 12 is attached to an opposing side and distal end of the first stringer 12. One end of a fourth stringer 12 is attached to an opposing side and distal end of the second stringer 12. The plurality of stair treads 14 are attached to the first and second stringers 12; or the third and fourth stringers 12. With reference to FIG. 16, a fifth short modular stairway embodiment 6 includes the plurality of stair treads 14 and four stringers 12. One end of a first stringer 12 is attached to a side and distal end of a second stringer. One end of a third stringer 12 is attached to a side and distal end of a fourth stringer 12. The plurality of stair treads 14 are attached to the first and second stringers 12; or the third and fourth stringers 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A modular stairway comprising:

a tubular beam;

a plurality of stringers each including an elongated section, said elongated section having at least three sides, a pair of said plurality of stringers are attached to opposing sides of said tubular beam at one end thereof, a second pair of said plurality of stringers are attached to said opposing sides of said tubular beam at an opposing end of said tubular beam; and a plurality of stair treads are attached to said tubular beam and said plurality of stringers, each one of said plurality of stair treads includes a step section, a first attachment flange, a support section and a second attachment flange, said first attachment flange extends inward from one side of said step section, said support section extends downward from an opposing side of said step section, said second attachment flange extends inward from a distal end of said support section, a plurality of fastener holes are formed through said first and second attachment flanges.

2. The modular stairway of claim 1 wherein:

each of said plurality of stringers includes a chamfer formed on an end of two opposing sides of said at least three sides.

3. The modular stairway of claim 1 wherein:

each of said plurality of stringers includes a plurality of fastener holes formed through each of said at least three sides.

4. The modular stairway of claim 1 wherein:

an end plate is attached to each end of said tubular beam.

5. The modular stairway of claim 4 wherein:

a flared portion extends outward from two opposing sides of each of said plurality of stringers to provide additional support for a stringer end plate.

6. A modular stairway comprising:

a tubular beam;

a plurality of stringers each having an elongated section, said elongated section having at least three sides, a plurality of stringer access openings are formed through at least one of said three sides, a pair of said plurality of stringers are attached to opposing sides of said tubular beam at one end thereof, a second pair of said plurality of stringers are attached to opposing sides of said tubular beam at an opposing end thereof; and a plurality of stair treads are attached to said tubular beam and said plurality of stringers, each one of said plurality of stair treads includes a step section, a first attachment flange, a support section and a second attachment flange, said first attachment flange extends inward from one side of said step section, said support section extends downward from an opposing side of said step section, said second attachment flange extends inward from a distal end of said support section, a plurality of fastener holes are formed through said first and second attachment flanges.

7. The modular stairway of claim 6 wherein:

each of said plurality of stringers includes a chamfer formed on a first end of two opposing sides of said at least three sides.

8. The modular stairway of claim 7 wherein:

an end plate is attached to an opposing second end of each of said plurality of stringers.

9. The modular stairway of claim 6 wherein:

each of said plurality of stringers includes a plurality of fastener holes formed through each of said at least three sides.

10. The modular stairway of claim 6 wherein:

an end plate is attached to each end of said tubular beam.

11. A modular stairway comprising:

at least two stringers each having an elongated section and an end plate, said elongated section includes at least three sides said end plate is attached to one end of said elongated section, a chamfer is formed on an opposing end of two opposing sides of said at least three sides; and a plurality of stair treads each having a step section, a first attachment flange, a support section and a second attachment flange, said first attachment flange extends inward from one side of said step section, said support section extends downward from an opposing side of said step section, said second attachment flange extends inward from a distal end of said support section, a plurality of fastener holes are formed through said first and second attachment flanges, wherein said plurality of stair treads are attached to said at least two stringers.

12. The modular stairway of claim 11 wherein:

a plurality of access openings are formed through at least one of said at least three sides, a plurality of fastener openings are formed through two opposing sides of said at least three sides.

13. The modular stairway of claim 11 wherein:

one end of said plurality of stair treads are attached to a first one of said at least two stringers, an opposing end of said plurality of stair treads are attached to a second one of said at least two stringers.

14. The modular stairway of claim 11 wherein:

a side of said at least two stringers are attached to each other, said plurality of stair treads are attached to said at least two stringers.

15. The modular stairway of claim 14 wherein:

a third stringer is attached to one side of said at least two stringers, a fourth stringer is attached to an opposing side of said at least two stringers, said plurality of stair treads are attached to said at least two stringers or said third and fourth stringers.

16. The modular stairway of claim 11 wherein:

one end of said plurality of stair treads are attached to a first one of said at least two stringers, an opposing end of said plurality of stair treads are attached to a second one of said at least two stringers, one end of a second plurality of stringers are attached to said second one of said at least two stringers, an opposing end of said second plurality of stringers is attached to a third stringer.

17. The modular stairway of claim 11 wherein:

two first outside stringers of said at least two stringers are attached to one side of a center stringer of said at least two stringers, two second outside stringers of said at least two stringers are attached to an opposing side of said center stringer, said plurality of stair treads are fastened to said first and second outside stringers.

* * * * *